US005406319A

United States Patent [19]

Hayes et al.

[11] Patent Number: 5,406,319

[45] Date of Patent: * Apr. 11, 1995

[54] ENHANCED U TYPE INK JET PRINTHEADS

[75] Inventors: Donald J. Hayes, Plano; John R. Pies; David B. Wallace, both of Dallas, all of Tex.

[73] Assignee: Compaq Computer Corporation, Houston, Tex.

[ * ] Notice: The portion of the term of this patent subsequent to Aug. 10, 2010 has been disclaimed.

[21] Appl. No.: 65,920

[22] Filed: May 20, 1993

Related U.S. Application Data

[63] Continuation-in-part of Ser. No. 859,671, Mar. 30, 1992, and Ser. No. 748,220, Aug. 16, 1991, Pat. No. 5,235,352.

[51] Int. Cl.[6] ..... B41J 2/045

[52] U.S. Cl. ..... 347/71

[58] Field of Search ..... 347/68, 69, 70, 71, 347/94; B41J 2/045, 2/055

[56] References Cited

U.S. PATENT DOCUMENTS

| | | | |
|---|---|---|---|
| 3,857,049 | 12/1974 | Zoltan | 310/8.1 |
| 4,367,480 | 1/1983 | Kotoh | 347/71 |
| 4,536,097 | 8/1985 | Nilsson | 400/126 |
| 4,567,493 | 1/1986 | Ikeda et al. | 347/64 |
| 4,584,590 | 4/1986 | Fischbeck et al. | 346/140 R |
| 4,825,227 | 4/1989 | Fischbeck et al. | 346/1.1 |
| 4,879,568 | 11/1989 | Bartky et al. | 346/140 R |
| 4,887,100 | 12/1989 | Michaelis et al. | 346/140 R |
| 4,963,882 | 10/1990 | Hickman | 346/1.1 |
| 5,016,028 | 5/1991 | Temple | 346/140 R |
| 5,235,352 | 8/1993 | Pies et al. | 347/71 |
| 5,252,994 | 10/1993 | Narita et al. | 347/71 |

FOREIGN PATENT DOCUMENTS

| | | | |
|---|---|---|---|
| 0364136 | 4/1990 | European Pat. Off. | B41J 2/045 |
| 0402172 | 12/1990 | European Pat. Off. | B41J 2/045 |
| 0484983 | 11/1991 | European Pat. Off. | B41J 2/135 |
| 0485241 | 5/1992 | European Pat. Off. | B41J 2/045 |
| 0528647 | 8/1992 | European Pat. Off. | B41J 2/045 |
| 0528648 | 8/1992 | European Pat. Off. | B41J 2/045 |
| 0528649 | 8/1992 | European Pat. Off. | B41J 2/16 |
| 3820082 | 12/1988 | Germany . | |
| 9319940 | 10/1993 | WIPO | B41J 2/16 |

OTHER PUBLICATIONS

"Printer Technology for the Year 2000", *Electronic Engineering*, vol. 57, No. 703, pp. 12–14 (Jul., 1985).

Wallace, David B. entitled "A Method of Characteristic Model of a Drop-on-Demand Ink-Jet Device Using an Integral Method Drop Formation Model", *89-WA/-FE-4* (1989).

Tsao, C. S., entitled "Drop-on-Demand Ink Jet Nozzle Array with Two Nozzle/Piezoelectric Crystal", *IBM Technical Disclosure Bulletin*, vol. 23, No. 10 (Mar. 1981).

*Primary Examiner*—Benjamin R. Fuller
*Assistant Examiner*—Alrick Bobb
*Attorney, Agent, or Firm*—Konneker Bush Hitt & Chwang

[57] ABSTRACT

The operation of U type drop-on-demand ink jet printheads are enhanced by selectively incorporating therein volume modifying tapers in the ink carrying channels, means for electrically isolating portions of the actuators thereof, and/or forming a variable layer of conductive material between the upper and lower sidewall portions therefore.

17 Claims, 2 Drawing Sheets

ENHANCED U TYPE INK JET PRINTHEADS

CROSS REFERENCE TO RELATED APPLICATIONS

This application is a Continuation-in-part of U.S. patent application Ser. Nos. 07/748,220, filed Aug. 16, 1991, entitled "High Density Ink Jet Printhead", now U.S. Pat. No. 5,235,352, and Ser. No. 07/859,671, filed Mar. 30, 1992, entitled "High Density Ink Jet Printhead with Double-U Channel Actuator". Both of these applications are assigned to the Assignee of the present application and are hereby incorporated by reference as if reproduced in their entirety.

BACKGROUND OF THE INVENTION

1. Field of the Invention

The present invention generally relates to ink jet printhead apparatus and, more particularly, to a drop-on-demand type ink jet printhead having longitudinally extending sidewall actuators piezoelectrically driven by generation of either a U or UU type electric field.

2. Description of Related Art

Ink jet printing systems use the ejection of tiny droplets of ink to produce an image. The devices produce highly reproducible and controllable droplets, so that a droplet may be printed at a location specified by digitally stored image data. Most ink jet printing systems commercially available may be generally classified as either a "continuous jet" type ink jet printing system where droplets are continuously ejected from the printhead and either directed to or away from the paper depending on the desired image to be produced or as a "drop-on-demand" type ink jet printing system where droplets are ejected from the printhead in response to a specific command related to the image to be produced.

In drop-on-demand type ink jet printing systems, a volumetric change in the fluid is induced by the application of a voltage pulse to a piezoelectric material which is directly or indirectly coupled to the fluid. This volumetric change causes pressure/velocity transients to occur in the fluid and these are directed so as to produce a droplet that issues from an orifice. Recently, considerable interest has been directed to piezoelectric drop-on-demand type ink jet printheads which utilize sidewall actuators to impart droplet ejecting pressure pulses into the ink carrying channels. See, for example, U.S. Pat. Nos. 4,536,097 to Nilsson, 4,879,568 to Bartky et al., 4,887,100 to Michaelis et al. and 5,016,028 to Temple.

In Ser. No. 07/748,220, a U type drop-on-demand ink jet printhead was disclosed. The U type ink jet printhead included a lower body portion formed from an active piezoelectric material, a plurality of intermediate sections formed from an active piezoelectric material and an upper body portion formed from an inactive material. The lower body portion further included an upper side surface and a plurality of generally parallel spaced projections vertically projecting therefrom. Lower side surfaces of a plurality of intermediate sections were conductively mounted to top side surfaces of the lower body projections and the upper body portion was conductively mounted to upper side surfaces of the plurality of intermediate sections. In this manner, an ink jet printhead in which the lower body portion, the plurality of intermediate sections and the upper body portion defined a plurality of generally parallel, longitudinally extending ink ejecting channels was formed. For this ink jet printhead, the intermediate sections further defined first and second actuators and the projections and upper surface of the lower body portion defined a third actuator for each of the channels.

In Ser. No. 07/859,671, a UU type drop-on-demand ink jet printhead was disclosed. The UU type ink jet printhead included lower and upper body portions formed from an active piezoelectric material. The lower body portion further included an upper side surface and a plurality of generally parallel spaced projections vertically projecting therefrom and the upper body portion includes a lower side surface and a plurality of generally parallel space projections projecting vertically therefrom. Top side surfaces of the lower body projections were then conductively mounted to bottom side surfaces of the upper body projections to form a plurality of generally parallel, longitudinally extending channels from which ink may be ejected therefrom. In this manner, an ink jet printhead in which the projections and upper surface of the lower body portion defined a first actuator and the projections and lower surface of the upper body portion defined a second actuator for each of the channels was formed.

While representing a significant improvement over prior drop-on-demand ink jet printhead in most regards, the above-described U and UU type drop-on-demand ink jet printheads lack a certain amount of flexibility in the ability to modulate the droplet ejecting pressure wave. More specifically, because the entire length of each channel is electrically and mechanically the same, the U and UU type ink jet printheads are unable to utilize electrical and mechanical variations in the structure of the printhead to vary the shape of the pressure waves generated thereby.

It is, therefore, an object of this invention to provide enhanced U and UU type drop-on-demand ink jet printheads which incorporate electrical and/or mechanical variations in the structure thereof capable of modifying the shape of pressure waves generated thereby and consequently affect ink droplets ejected thereby in a manner which enhances the ability of the printheads to perform spot size modulation.

SUMMARY OF THE INVENTION

In one aspect, the present invention is of an enhanced U type drop-on-demand ink jet printhead having a lower body portion formed from an active piezoelectric material, a plurality of intermediate sections formed from an active piezoelectric material and an upper body portion formed from an inactive material. The lower body portion includes an upper side surface and a plurality of generally parallel spaced projections vertically projecting therefrom. Lower side surfaces of a plurality of intermediate sections are conductively mounted to top side surfaces of the lower body projections and the upper body portion is conductively mounted to upper side surfaces of the plurality of intermediate sections. In this manner, the lower body portion, the plurality of intermediate sections and the upper body portion define a plurality of generally parallel, longitudinally extending channels from which ink may be ejected therefrom. The intermediate sections define first and second actuators and the projections and upper surface of the lower body portion define a third actuator for each of the channels. In various aspects thereof, the ink jet printhead further includes an upwardly tapered upper surface extending between a first interior surface line to a front end surface of the lower body portion, means for electrically isolating a part of the lower body portion, and/or a variable layer of conductive material provided between the top side surfaces of the lower body projections and the bottom side surfaces of the intermediate sections.

In another embodiment, the present invention is of an enhanced UU type drop-on-demand ink jet printhead having lower and upper body portions formed from an active piezoelectric material. The lower body portion includes an upper side surface and a plurality of generally parallel spaced projections vertically projecting therefrom and the upper body portion includes a lower side surface and a plurality of generally parallel space projections projecting vertically therefrom. Top side surfaces of the lower body projections are conductively mounted to bottom side surfaces of the upper body projections to form a plurality of generally parallel, longitudinally extending channels from which ink may be ejected therefrom. In various aspects thereof, the ink jet printhead further includes an upwardly tapered upper surface extending between a first interior surface line to a front end surface of the lower body portion, means for electrically isolating a part of the lower body portion, and/or a variable layer of conductive material provided between the top side surfaces of the lower body projections and the bottom side surfaces of the upper body projections.

BRIEF DESCRIPTION OF THE DRAWING

The invention will be more clearly understood and its numerous objects and advantages will become apparent to those skilled in the art by reference to the accompanying drawing in which.

DETAILED DESCRIPTION

Figure 1:
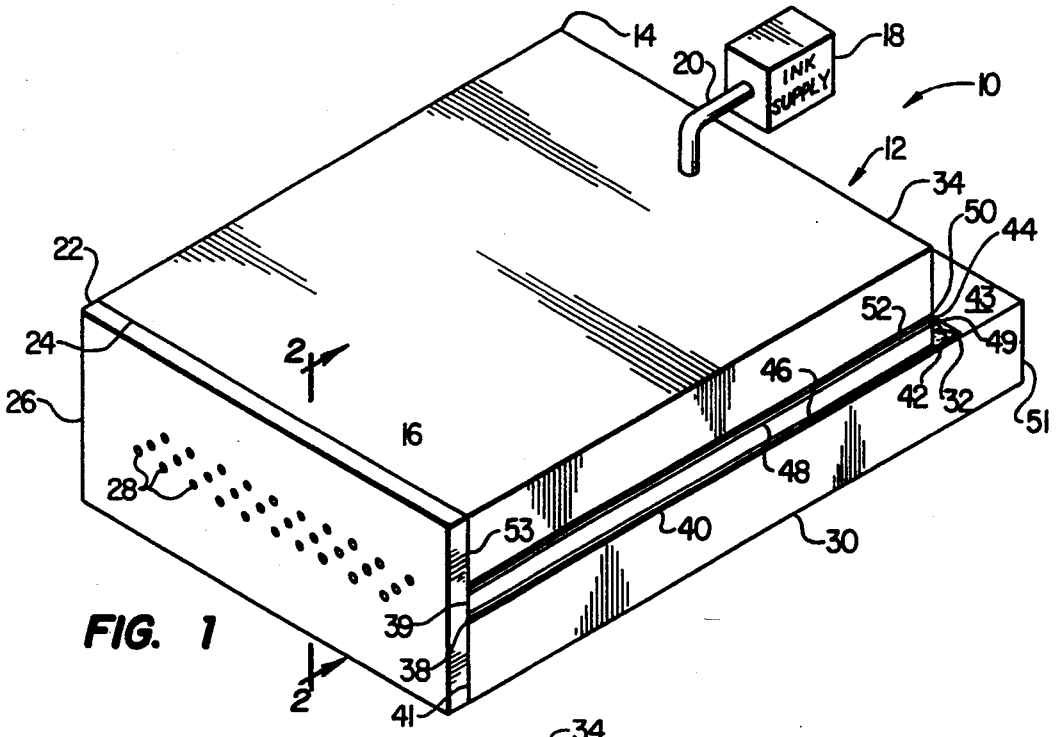
FIG. 1 is a perspective view of an enhanced U type ink jet printhead constructed in accordance with the teachings of the present invention.

Referring now to the drawing wherein thicknesses and other dimensions have been exaggerated in the various figures as deemed necessary for explanatory purposes and wherein like reference numerals designate the same or similar elements throughout the several views, in FIG. 1, a drop-on-demand type ink jet printer 10 incorporating therein an enhanced U type ink jet printhead 12 constructed in accordance with the teachings of the present invention may now be seen. The U type ink jet printhead 12 includes a main body portion 14 having a plurality of ink carrying channels (not visible in FIG. 1) longitudinally extending therethrough. Typically, each of the ink carrying channels extend from a first end located within the main body portion 14 and terminate at an opening along a front side Surface 16 of the main body portion 14. Preferably, the ink carrying channels should be generally parallel to each other along their entire length.

Ink is supplied to the ink carrying channels from an ink supply 18 via an external conduit 20. Many methods for supplying ink from the ink supply 18 to the ink carrying channels are known in the art and, therefore, need not be described in greater detail here. For example, for the U type ink jet printhead 12, the external conduit 20 delivers the ink to a vertically orientated internal conduit (not shown) which, in turn, supplies the ink to a manifold (also not shown) which extends within the interior of the U type ink jet printhead 12 in a direction generally normal to the longitudinally extending ink carrying channels. As the manifold is in communication with each of the generally parallel longitudinally extending ink carrying channels, ink may be drawn into the ink carrying channels from the manifold.

Continuing to refer to FIG. 1, the U type ink jet printhead 12 further includes a cover plate 22 having a back side surface 24 fixedly secured to the front side surface 16 of the main body portion 14, a front side surface 26 and a plurality of tapered orifices 28 extending therethrough. Preferably, the cover plate 22 should be formed of polyamide or another suitable material and fixedly secured to the front side surface 16 such that each orifice 28 is in communication with one of the ink carrying channels.

Continuing to refer to FIG. 1, the main body portion 14 will now be described in greater detail. The main body portion 14 is comprised of a lower body portion 30 formed of an active piezoelectric material, for example, lead zirconate titante (or "PZT"), poled in direction P1 and having a layer 38 of a conductive material, for example, metal, formed on a top side surface 40 thereof, an intermediate body portion 32, also formed of an active piezoelectric material, poled in direction P1 and having layers 42, 44 of a conductive material formed on bottom and top side surfaces 46, 48, respectively, and an upper body portion 34 formed of an inactive material, for example an unpoled piezoelectric or ceramic material, and having a layer 50 of a conductive material formed on a lower side surface 52 thereof.

Figure 3:
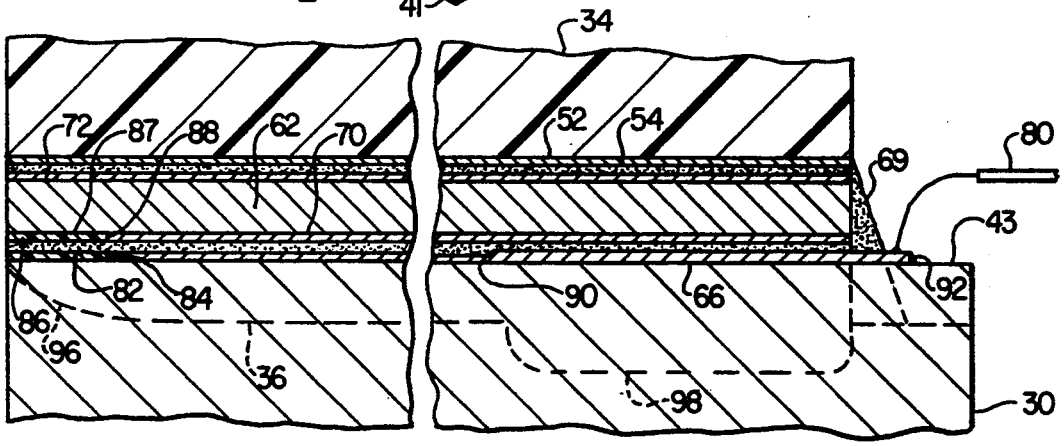
FIG. 3 is a longitudinally foreshortened, cross-sectional view taken along lines 3—3 of FIG. 2.
Figure 2:
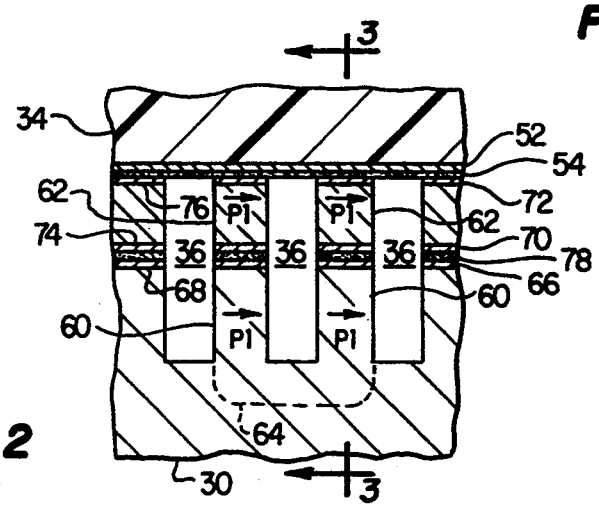
FIG. 2 is a partial cross-sectional view taken along lines 2—2 of FIG. 1 and illustrating an array of longitudinally extending, sidewall actuatable, internal ink carrying channels of the enhanced U type ink jet printhead of FIG. 1.

Referring now to FIGS. 1, 2 and 3, the manufacture of the U type ink jet printhead 12 will now be described in greater detail. To manufacture the U type ink jet printhead 12, a layer of conductive adhesive (not shown) is applied to the conductive layer 42 formed on the bottom side surface 46 of the intermediate body portion 32. Front side surfaces 39, 41 of the intermediate and lower body portions 32, 30, respectively, are then aligned and the lower and intermediate body portions 30, 32 mated and bonded with each other. As may be best seen in FIG. 3, the lower body portion 30 continues to extend rearwardly past the intermediate body portion 32, thereby providing a so-called "back porch" 43 for the U type ink jet printhead 12 where an electrical interconnection between an actuation system for the U type ink jet printhead 12 to be more fully described below and a controller (not shown) is provided. To better facilitate this electrical interconnection, it is preferred that the conductive layer 38 formed on the top side surface 40 of the lower body portion 30 extend only partway along the back porch 43. This may be accomplished by covering a portion of the back porch 43 with a thin layer of an insulative material, for example, an insulative synthetic resin polymer product such as TEFLON, before forming the conductive layer 38 on the top side surface 40, most commonly, using a conventional deposition process.

After the lower body portion 30 and the intermediate body portion 32 are conductively mounted together, a machining process is then utilized to form a channel array for the U type ink jet printhead 12. As may be seen in FIG. 2, a series of longitudinally extending, substantially parallel channels 36 are formed by machining grooves which extend through the intermediate body portion 32 and the lower body portion 30. Preferably, the machining process is performed such that each channel 36 formed thereby extends downwardly such that portions of the conductive layer 44, the intermediate body portion 32, the conductive layer 42, the conductive adhesive layer between conductive layers 42 and 38, the conductive layer 38 and the lower body portion 30 are removed. It is further preferred that the machining process be performed such that the grooves formed thereby longitudinally extend from the front side surfaces 39, 41 to rear side surfaces 49, 51 of the intermediate and lower body portions 32, 30, respectively. A layer 54 of conductive adhesive is then applied to the conductive layer 52 and a front side surface 53 of the upper body portion 34 is aligned with the front side surface 39 of the intermediate body portion 32 and the two conductively mounted together. Finally, an insulative composite material 69 forms back walls for the channels 36 by closing the open ends of the channels 36 along the rear side surfaces 49, 51 of the lower and intermediate body portions 30, 32.

By forming grooves in the lower and intermediate body portions 30, 32 and mounting the upper body portion 34 to the grooved intermediate body portion 32 in this manner, a series of channels 36 which comprise the channel array for the U type ink jet printhead 12 are formed. Each channel 36 is separated from an adjacent channel by a first sidewall portion 60 integrally formed with the lower body portion 32 and having a conductive strip 66 formed along a top side surface 68 of the sidewall portion 60 and a second sidewall portion 62 having conductive strips 70, 72 formed along bottom and top side surfaces 74, 76 of the second sidewall portion. The conductive strips 66 and 74 are bonded together by a strip 78 of conductive adhesive. Finally, each conductive strip 66 is electrically connected, for example, by a soldering process, along the back porch 43 to an electrical conductor 80 associated with a controller (not shown).

As more fully described in Ser. No. 07/748,220, each channel 36 has three actuators for imparting a pressure pulse into the channel. Two of these actuators are respectively comprised of the second sidewall portions 62 which partially define first and second sidewalls of the channel 36. The third (or "U-field") actuator 64 is comprised of the pair of first sidewall portions 60 which partially define the first and second sidewalls of the channel 36, respectively, and that portion of the lower body portion 30 which interconnects the pair of first sidewall actuator portions 60. Further details regarding how the actuators 62 and 64 impart pressure pulses to the channels 36 to cause the ejection of droplets of ink therefrom is set forth in greater detail in Ser. No. 07/748,220 and need not be discussed in greater detail here.

Continuing to refer to FIG. 3, certain structural modifications, both electrical and mechanical, to the U type ink jet printhead 12 which provide enhanced control of the pressure wave formation process and, consequently, the droplet ejection process in a manner which enhances the ability of the printheads to perform spot size modulation will now be described in greater detail. It is specifically contemplated that the operation of the U type ink jet printhead 12 will be enhanced by incorporation of one or more of these structural modifications.

One enhancement of the U type ink jet printhead 12 is achieved by modifying the electrical response of the channels 36. More specifically, the electrical response along the length of the channel 36 is varied by making a front end portion of the channel 36 inactive by electrically isolating that portion of the channel 36. While it is contemplated that electrical isolation may be accomplished using various techniques, one such technique would be to, prior to the metallization thereof, place a layer 82 of an insulative material, for example, an insulative synthetic resin polymer product such as TEFLON, over a portion of the upper side surface 40 of the lower body portion 30 which extends from the front end surface 41 to an interior surface line 84 generally parallel with the front end surface 41. A layer 38 of conductive material would then be formed on the remainder of the upper side surface 40 of the lower body portion 30, for example, using a conventional deposition process. Similarly, a layer 87 of insulative material should be placed on a portion of the lower side surface 46 of the intermediate body portion 32 which extends from the front end surface 39 to an interior surface line 88 generally parallel with the front end surface 39. Preferably, the interior surface lines 84, 88 should be equal distances from the front end surfaces 41, 39, respectively. Assembly of the U type ink jet printhead 12 would then continue in the manner previously described. In this manner, a U type ink jet printhead 12 in which the front portion of each channel 36 is inactive would be formed. As the front portion of each channel 36 is inactive, the amount of sidewall motion produced by the application of a voltage thereto would be reduced. The pressure waves imparted to the channels 36 would be significantly shortened and therefore be easier to modulate.

To further enhance the U type ink jet printhead 12, the electrical response of the actuators 60, 64 may be varied along the length of the printhead. To do so, the thickness of the conductive strips 66 are varied along the length of the channels 36. To modify the U type ink jet printhead 12 in this manner, the conductive layer 38 should be deposited on the upper side surface 40 of the lower body portion 30 in varied thicknesses. Preferably, the conductive layer 38 should be formed to have a lesser thickness, for example, 0.25 micron, between the interior surface line 84 and an interior surface line 90 generally parallel with the front and back end surfaces 41, 51 and a greater thickness, for example, 1.00 micron, between the interior surface line 90 and an interior surface line 92, also generally parallel with the front and back end surfaces 41, 51. As before, assembly of the U type ink jet printhead 12 would then continue in the manner previously described. In this manner, an enhanced U type ink jet printhead 12 in which the electrical response of the actuators 60, 64 varies along the length of the channels 36 would be formed. More specifically, electric charge would build up in the portion of the actuators 62, 64 between the interior surface lines 90 and 92 than in the portion of the actuators 62, 64 between the interior surface lines 84 and 90. Accordingly, the portion of the actuators 62, 64 between the interior surface lines 90 and 92 would more quickly begin to deflect into the channels 36. This makes it possible for the now different pressure waves imparted generated at various locations along the channels 36 to cancel and/or combine with each other. This added flexibility in generating pressure waves would make it easier to modulate the volume of ink droplets ejected by the channels.

To still further enhance operation of the U type ink jet printhead 12, the channels 36 may be formed having an upward (or "channel volume reducing") taper 96 or a downward (or "channel volume increasing") taper 98 formed therein. Preferably, volume reducing tapers 96 should be formed along the front end of the channels 36 while volume increasing tapers are best formed anywhere along the remainder of the channels 36. Such volume reducing or increasing tapers may be readily formed using a chop mode during the machining process which will cause the depth of the grooves to be gradually reduced towards the front end surface 41 and gradually increased towards the rear end surface. Preferably, the volume reducing taper 96 in the channels 36 should be carefully positioned such that it coincides with the electrically isolated portion of the channels 36 and the volume increasing taper 98 should be positioned such that the deepest portion of the channels 36 are located between the interior surface line 90 and the back wall of the channels 36. Again, by varying the depth of the channels 36, enhanced capabilities in modifying the pressure waves imparted into the channels 36 should be provided. More specifically, the actuators 62, 64 will be more compliant where the channels 36 are deepest and least compliant, or stiffest, where the channels 36 are the shallowest. Accordingly, the actuators 62, 64 would have more motion on one end and much less motion on the other. Pressure waves produced thereby would, therefore, have a significantly increased range of magnitude.

Figure 4:
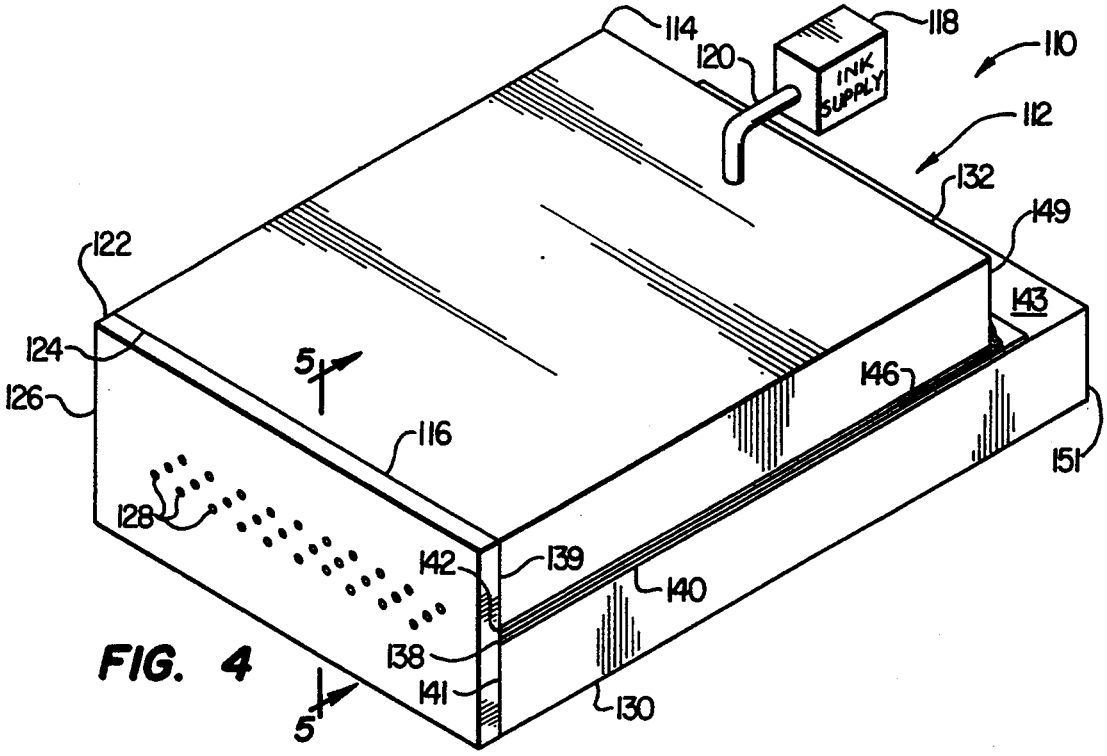
FIG. 4 is a perspective view of an enhanced UU type ink jet printhead constructed in accordance with the teachings of the present invention.

Referring next to FIG. 4, a drop-on-demand type ink jet printer 110 incorporating therein an enhanced UU type ink jet printhead 112 constructed in accordance with the teachings of the present invention may now be seen. The U type ink jet printhead 112 includes a main body portion 114 having a plurality of ink carrying channels (not visible in FIG. 1) longitudinally extending therethrough. Typically, each of the ink carrying channels extend from a first end located within the main body portion 114 and terminate at an opening along a front side surface 116 of the main body portion 114. Preferably, the ink carrying channels should be generally parallel to each other along their entire length.

Ink is supplied to the ink carrying channels from an ink supply 118 via an external conduit 120. Many methods for supplying ink from the ink supply 118 to the ink carrying channels are known in the art and, therefore, need not be described in greater detail here. For example, for the UU type ink jet printhead 112, the external conduit 120 delivers the ink to a vertically orientated internal conduit (not shown) which, in turn, supplies the ink to a manifold (also not shown) which extends within the interior of the UU type ink jet printhead 112 in a direction generally normal to the longitudinally extending ink carrying channels. As the manifold is in communication with each of the generally parallel longitudinally extending ink carrying channels, ink may be drawn into the ink carrying channels from the manifold.

Continuing to refer to FIG. 4, the UU type ink jet printhead 112 further includes a cover plate 122 having a back side surface 124 fixedly secured to the front side surface 116 of the main body portion 114, a front side surface 126 and a plurality of tapered orifices 128 extending therethrough. Preferably, the cover plate 122 should be formed of polyamide or another suitable material and fixedly secured to the front side surface 116 such that each orifice 128 is in communication with one of the ink carrying channels.

Continuing to refer to FIG. 4, the main body portion 114 will now be described in greater detail. The main body portion 114 is comprised of a lower body portion 130 formed of an active piezoelectric material, for example, lead zirconate titante (or "PZT"), poled in direction P1 and having a layer 138 of a conductive material, for example, metal, formed on a top side surface 140 thereof and an upper body portion 132, formed of an active piezoelectric material poled in direction P2 and having a layer 142 of a conductive material formed on a bottom side surface 146 thereof.

Figure 6:
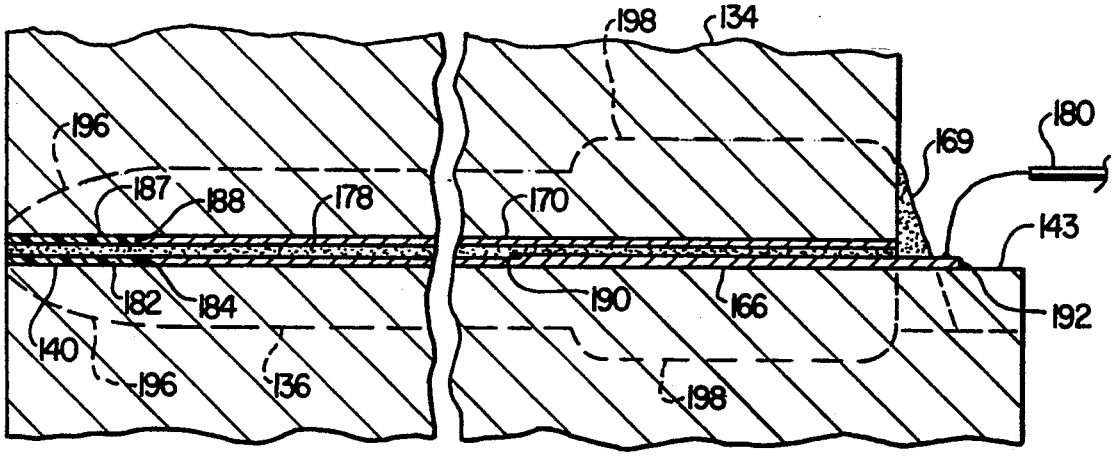
FIG. 6 is a longitudinally foreshortened, cross-sectional view taken along lines 6—6 of FIG. 5.
Figure 5:
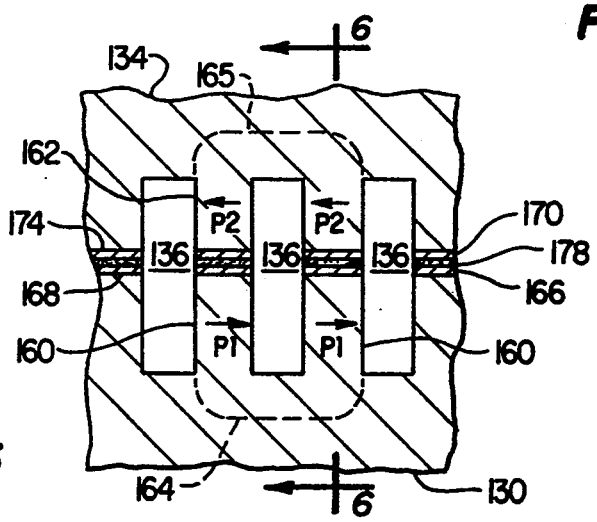
FIG. 5 is a partial cross-sectional view taken along lines 5—5 of FIG. 4 and illustrating an array of longitudinally extending, sidewall actuatable, internal ink carrying channels of the enhanced UU type ink jet printhead of FIG. 4

Referring now to FIGS. 4, 5 and 6 the manufacture of the UU type ink jet printhead 112 will now be described in greater detail. To manufacture the UU type ink jet printhead 112, a machining process is utilized to form a channel array for the UU type ink jet printhead 112. As may be seen in FIG. 2, a series of longitudinally extending, substantially parallel channels 136 are formed by machining a first series of grooves which extend through the lower body portion 130 and a second, corresponding series of grooves which extend through the upper body portion 132. Preferably, the machining process is performed such that grooves formed in the lower body portion 130 extend downwardly such that portions of the conductive layer 138 and the lower body portion 130 are removed and grooves formed in the upper body portion extend upwardly such that portions of the conductive layer 142 and the upper body portion 132 are removed. It is further preferred that the machining process be performed such that the grooves formed thereby longitudinally extend from the front side surfaces 139, 141 to rear side surfaces 149, 151 of the upper and lower body portions 132, 130, respectively. A layer of conductive adhesive 178 is then applied to either of the lower or upper body portions 130 or 132, and front side surfaces 139, 141 of the upper and lower body portions 132, 130, respectively, are then aligned and the lower and upper body portions 130, 132 mated and bonded with each other to form a series of longitudinally extending, generally parallel channels 136.

As may be best seen in FIG. 6, the lower body portion 130 continues to extend rearwardly past the upper body portion 132, thereby providing a so-called "back porch" 143 for the UU type ink jet printhead 112 where an electrical interconnection between an actuation system for the UU type ink jet printhead 112 to be more fully described below and a controller (not shown) is provided. To better facilitate this electrical interconnection, it is preferred that the conductive layer 138 formed on the top side surface 140 of the lower body portion 130 extend only partway along the back porch 143. This may be accomplished by covering a portion of the back porch 143 with a thin layer of an insulative material, for example, an insulative synthetic resin polymer product such as TEFLON, before forming the conductive layer 138 on the top side surface 140, most commonly, using a conventional deposition process. After the lower body portion 130 and the upper body portion 132 are conductively mounted together, an insulative composite material 169 forms back walls for the channels 136 by closing the open ends of the channels 136 along the rear side surfaces 149, 151 of the upper and lower body portions 132, 130.

By forming grooves in the lower and upper body portions 130, 132 and mounting the grooved body portions of the upper body portion 132 to the grooved lower body portion 130 such that top side surfaces 168 of the lower body projections are mounted to the corresponding bottom side surfaces 174 of the upper body projections, a series of channels 136 which comprise the channel array for the UU type ink jet printhead 112 are formed. Each channel 136 is separated from an adjacent channel by a first sidewall portion 160 integrally formed with the lower body portion 130 and having a conductive strip 166 formed along the top side surface 168 thereof and a second sidewall portion 162 integrally formed with the upper body portion 132 and having a conductive strip 170 formed along the bottom side surface 174 thereof. The conductive strips 166 and 174 are bonded together by the strip 178 of conductive adhesive. Finally, each conductive strip 166 is electrically connected, for example, by a soldering process, along the back porch 143 to an electrical conductor 80 associated with a controller (not shown).

As more fully described in Ser. No. 07/859,671, each channel 136 has first and second U type actuators 164, 165 for imparting a pressure pulse into the channel. The first (164) of these actuators is comprised of the pair of first sidewall portions 160 which partially define the first and second sidewalls of the channel 136, respectively, and that portion of the lower body portion 130 which interconnects the pair of first sidewall actuator portions 160 and the second (165) of these actuators is comprised of the pair of second sidewall portions 162 which partially define the first and second sidewalls of the channel 136, respectively, and that portion of the upper body portion 132 which interconnects the pair of second sidewall actuator portions 162. Further details regarding how the actuators 164 and 165 impart pressure pulses to the channels 136 to cause the ejection of droplets of ink therefrom is set forth in greater detail in Ser. No. 07/859,671 and need not be discussed in greater detail here.

Continuing to refer to FIG. 6, certain structural modifications, both electrical and mechanical, to the UU type ink jet printhead 112 which provide enhanced control of the pressure wave formation process and, consequently, the droplet ejection process in a manner which enhances the ability of the printheads to perform spot size modulation will now be described in greater detail. It is specifically contemplated that the operation of the UU type ink jet printhead 112 will be enhanced by incorporation of one or more of these structural modifications.

One enhancement of the U type ink jet printhead 112 is achieved by modifying the electrical response of the channels 136. More specifically, the electrical response along the length of the channel 136 is varied by making a front end portion of the channel 136 inactive by electrically isolating that portion of the channel 136. While it is contemplated that electrical isolation may be accomplished using various techniques, one such technique would be to, prior to the metallization thereof, place a layer 182 of an insulative material, for example, an insulative synthetic resin polymer product such as TEFLON, over a portion of the upper side surface 140 of the lower body portion 130 which extends from the front end surface 141 to an interior surface line 184 generally parallel with the front end surface 141. A layer 138 of conductive material would then be formed on the remainder of the upper side surface 140 of the lower body portion 130, for example, using a conventional deposition process. Similarly, a layer 187 of insulative material should be placed on a portion of the lower side surface 146 of the upper body portion 132 which extends from the front end surface 139 to an interior surface line 188 generally parallel with the front end surface 139. Preferably, the interior surface lines 184, 188 should be equal distances from the front end surfaces 141, 139, respectively. Assembly of the UU type ink jet printhead 112 would then continue in the manner previously described. In this manner, a UU type ink jet printhead 112 in which the front portion of each channel 136 is inactive would be formed. As the front portion of each channel 136 is inactive, the amount of sidewall motion produced by the application of a voltage thereto would be reduced. The pressure waves imparted to the channels 136 would be significantly shortened and therefore be easier to modulate.

To further enhance the UU type ink jet printhead 112, the electrical response of the actuators 164, 165 may be varied along the length of the printhead. To do so, the thickness of the conductive strips 166 are varied along the length of the channels 136. To modify the UU type ink jet printhead 112 in this manner, the conductive layer 138 should be deposited on the upper side surface 140 of the lower body portion 130 in varied thicknesses. Preferably, the conductive layer 138 should be formed to have a lesser thickness, for example, 0.25 micron, between the interior surface line 184 and an interior surface line 190 generally parallel with the front and back end surfaces 141, 151 and a greater thickness, for example, 1.00 micron, between the interior surface line 190 and an interior surface line 192, also generally parallel with the front and back end surfaces 141, 151. As before, assembly of the UU type ink jet printhead 112 would then continue in the manner previously described. In this manner, an enhanced UU type ink jet printhead 112 in which the electrical response of the actuators 164, 165 varies along the length of the channels 136 would be formed. More specifically, electric charge would build up in the portion of the actuators 164, 165 between the interior surface lines 190 and 192 than in the portion of the actuators 164, 165 between the interior surface lines 184 and 190. Accordingly, the portion of the actuators 164, 165 between the interior surface lines 190 and 192 would more quickly begin to deflect into the channels 136. This makes it possible for the now different pressure waves imparted generated at various locations along the channels 36 to cancel and/or combine with each other. This added flexibility in generating pressure waves would make it easier to modulate the volume of ink droplets ejected by the channels.

To still further enhance operation of the UU type ink jet printhead 112, the channels 136 may be formed having a volume reducing taper 196 or a volume increasing taper 198 formed therein. Preferably, volume reducing tapers 196 should be formed along the front end of the channels 136 while volume increasing tapers are best formed anywhere along the remainder of the channels 136. Such volume reducing or increasing tapers may be readily formed using a chop mode during the machining process which will cause the depth of the grooves to be gradually reduced towards the front end surface 141, 139 and gradually increased towards the rear end surface. It is contemplated that either the volume reducing or volume increasing tapers 196, 198 may be formed in either the lower body portion 130, the upper body portion 132 or both. Preferably, the volume reducing taper 196 in the channels 136 should be carefully positioned such that it coincides with the electrically isolated portion of the channels 136 and the volume decreasing taper 198 should be positioned such that the deepest portion of the channels 136 are located between the interior surface line 190 and the back wall of the channels 136. Again, by varying the depth of the channels 136, enhanced capabilities in modifying the pressure waves imparted into the channels 136 should be provided. More specifically, the actuators 164, 165 will be more compliant where the channels 136 are deepest and least compliant, or stiffest, where the channels 136 are the shallowest. Accordingly, the actuators 164, 165 would have more motion on one end and much less motion on the other. Pressure waves produced thereby would, therefore, have a significantly increased range of magnitude.

Thus, there has been described and illustrated herein, enhanced U and UU type drop-on-demand ink jet printheads which have improved flexibility in modifying the characteristics of pressure waves imparted to the channels and consequently modify the characteristics of droplets ejected therefrom. However, those skilled in the art will recognize that many modifications and variations besides those specifically mentioned may be made in the techniques described herein without departing substantially from the concept of the present invention. Accordingly, it should be clearly understood that the form of the invention as described herein is exemplary only and is not intended as a limitation on the scope of the invention.

What is claimed is:

1. An enhanced U type drop-on-demand ink jet printhead, comprising:

a lower body portion formed from an active piezoelectric material, said lower body portion having a back end surface, a front end surface, an upper side surface and a plurality of generally parallel spaced projections, each of said projections having a top side surface and first and second side surfaces, each of said projections projecting vertically from said upper side surface and extending longitudinally along said lower body portion, said upper side surface being upwardly tapered from a first interior surface line to said front end surface, said first interior surface line being generally parallel with said front end surface;

a plurality of intermediate sections, each of said intermediate sections having first and second side surfaces, an upper side surface, and a lower side surface conductively mounted on said top side surface of a corresponding one of said plurality of lower body portion projections, each of said intermediate sections formed from an active piezoelectric material; and an upper body portion having a lower side surface conductively mounted to said upper side surface of each of said plurality of intermediate sections, said upper body portion formed from an inactive material; wherein said upper side surface of said lower body portion, said first and second side surfaces of said plurality of projections, said first and second side surfaces of said plurality of intermediate sections and said lower side surface of said upper body portion define a plurality of generally parallel, longitudinally extending channels having a volume reducing taper extending from said first interior surface line to said front end surface from which ink may be ejected therefrom; and wherein said intermediate sections form first and second actuators for each one of said plurality of channels, and said projections and said upper surface of said lower body portion form a third actuator for each one of said plurality of channels.

2. An enhanced U type drop-on-demand ink jet printhead according to claim 1 and further comprising means for electrically isolating a part of said lower body portion, another part of said lower body portion being non-electrically isolated.

3. An enhanced U type drop-on-demand ink jet printhead according to claim 2 wherein said electrically isolated part of said lower body portion extends from a second interior surface line to said front end surface, said second interior surface line generally parallel with said front end surface.

4. An enhanced U type drop-on-demand ink jet printhead according to claim 2 wherein said electrically isolated part of said lower body portion extends from said first interior surface line to said front end surface.

5. An enhanced U type drop-on-demand ink jet printhead according to claim 2 wherein said means for electrically isolating a part of said lower body portion further comprises a layer of insulative material placed on said top side surface of each said projections in said electrically isolated part of said lower body portion.

6. An enhanced U type drop-on-demand ink jet printhead according to claim 5 and further comprising:

a first layer of conductive material formed on said top side surface of each of said projections in said non-electrically isolated part of said lower body portion;

a second layer of conductive material formed on said lower side surface of each of said intermediate sections; and a layer of conductive adhesive for mounting said first layer of conductive material and said layer of insulative material to said second layer of conductive material.

7. An enhanced U type drop-on-demand ink jet printhead according to claim 6 wherein said first layer of conductive material extends from a second interior surface line to said layer of insulative material, said second interior surface line being generally parallel with said front end surface and located between said first interior surface line and said back end surface, and wherein said first layer of conductive material has a thickness which varies between said second interior surface line and said layer of insulative material.

8. An enhanced U type drop-on-demand ink jet printhead according to claim 7 wherein said first layer of conductive material has a first thickness between said second interior surface line and a third interior surface line generally parallel with said front end surface and located between said layer of insulative material and said second interior surface line, and a second reduced thickness between said third interior surface line and said layer of insulative material.

9. An enhanced U type drop-on-demand ink jet printhead according to claim 5 and further comprising:

a first, variable thickness, layer of conductive material formed on said top side surface of each of said projections;

a second layer of conductive material formed on said lower side surface of each of said intermediate sections; and a layer of conductive adhesive for mounting said first layer and said layer of insulative material to said second layer.

10. An enhanced U type drop-on-demand ink jet printhead according to claim 9 wherein said first layer of conductive material extends between a second interior surface line and a third interior surface line generally parallel with said front end surface, said third interior surface line being located between said second interior surface, line and said back end surface and wherein said first layer of conductive material has a first thickness at said third interior surface line and a second, lesser thickness at said second interior surface line.

11. An enhanced U type drop-on-demand ink jet printhead, comprising:

a lower body portion formed from an active piezoelectric material, said lower body portion having a back end surface, a front end surface, an upper side surface and a plurality of generally parallel spaced projections, each of said projections having a top side surface and first and second side surface, each of said projections projecting vertically from said upper side surface and extending longitudinally along said lower body portion between said front and back end surfaces;

a plurality of intermediate sections, each of said intermediate sections having first and second side surfaces, an upper side surface, and a lower side surface conductively mounted on said top side surface of a corresponding one of said plurality of lower body portion projections, each of said intermediate sections formed from an active piezoelectric material;

an upper body portion having a lower side surface conductively mounted to said upper side surface of each of said plurality of intermediate sections, said upper body portion formed from an inactive material; and means for electrically isolating a part of said lower body portion which extends from a first interior surface line to said front end surface, said first interior surface line generally parallel with said front end surface, another part of said lower body portion which extends from said first interior surface line to said back end surface being non-electrically isolated; wherein said upper side surface of said lower body portion, said first and second side surfaces of said plurality of projections, said first and second side surface of said plurality of intermediate sections and said lower side surface of said upper body portion define a plurality of generally parallel, longitudinally extending channels from which ink may be ejected therefrom; and wherein said intermediate sections form first and second actuators for each one of said plurality of channels, and said projections and said upper surface of said lower body portion form a third actuator for each one of said plurality of channels.

12. An enhanced U type drop-on-demand ink jet printhead according to claim 11 wherein said means for electrically isolating a part of said lower body portion further comprises a layer of insulative material placed on said top side surface of each said projections in said electrically isolated part of said lower body portion.

13. An enhanced U type drop-on-demand ink jet printhead according to claim 12 and further comprising:

a first layer of conductive material formed on said non-electrically isolated top surface of each of said projections;

a second layer of conductive material formed on said lower side surface of each of said intermediate sections; and a layer of conductive adhesive for mounting said first layer and said layer of insulative material to said second layer.

14. An enhanced U type drop-on-demand ink jet printhead according to claim 13 wherein said first layer of conductive material extends from a second interior surface line to said layer of insulative material, said second interior surface line being generally parallel with said front end surface and located between said first interior surface line and said back end surface, and wherein said first layer of conductive material has a thickness which varies between said second interior surface line and said layer of insulative material.

15. An enhanced U type drop-on-demand ink jet printhead according to claim 14 wherein said first layer of conductive material has a first thickness between said second interior surface line and a third interior surface line generally parallel with said front end surface and located between said layer of insulative material and said second interior surface line and a second, reduced thickness between said third interior surface line and said layer of insulative material.

16. An enhanced U type drop-on-demand ink jet printhead, comprising:

a lower body portion formed from an active piezoelectric material, said lower body portion having a back end surface, a front end surface, an upper side surface and a plurality of generally parallel spaced projections, each of said projections having a top side surface and first and second side surfaces, each of said projections projecting vertically from said upper side surface and extending longitudinally along said lower body portion between said front and back end surfaces;

a plurality of intermediate sections, each of said intermediate sections having first and second side surfaces, an upper side surface and a lower side surface conductively mounted on said top side surface of a corresponding one of said plurality of lower body portion projections, each of said intermediate sections formed from an active piezoelectric material;

an upper body portion having a lower side surface conductively mounted to said upper side surface of each of said plurality of intermediate sections, said upper body portion formed from an inactive material;

a first, variable thickness, layer of conductive material formed on said top side surface of each of said projections;

a second layer of conductive material formed on said lower side surface of each of said intermediate sections; and a layer of conductive adhesive for mounting said first layer to said second layer; wherein said upper side surface of said lower body portion, said first and second side surfaces of said plurality of projections, said first and second side surfaces of said plurality of intermediate sections and said lower side surface of said upper body portion define a plurality of generally parallel, longitudinally extending channels from which ink may be ejected therefrom; and wherein said intermediate sections form first and second actuators for each one of said plurality of channels, and said projections and said upper surface of said lower body portion form a third actuator for each one of said plurality of channels.

17. An enhanced U type drop-on-demand ink jet printhead according to claim 16 wherein said first layer of conductive material extends between a first interior surface line and a second interior surface line generally parallel with said front end surface, said second interior surface line being located between said first interior surface line and said back end surface, and wherein said first layer of conductive material has a first thickness at said second interior surface line, and a second, lesser thickness at said first interior surface line.

* * * * *

Disclaimer 5,406,319—Donald J. Hayes, Plano; John R. Pies; David B. Wallace, both of Dallas, all of Texas. ENHANCED U TYPE INK JET PRINTHEADS. Patent dated April 11, 1995. Disclaimer filed on September 28, 1995, by the Assignee, Compaq Computer Corporation.

The term of this patent shall not extend beyond the expiration date of Patent No. 5,235,352.

*(Official Gazette, July 22, 2003)*